United States Patent [19]

Edwards et al.

[11] Patent Number: 4,948,073

[45] Date of Patent: Aug. 14, 1990

[54] TURNOUT WITH CLOSING FROG

[75] Inventors: Clarence K. Edwards, Medford; Lawrence D. Edwards, Eagle Point, both of Oreg.

[73] Assignee: Kadee Metal Products, Co., Medford, Oreg.

[21] Appl. No.: 261,221

[22] Filed: Oct. 24, 1988

[51] Int. Cl.[5] ..... E01B 7/00

[52] U.S. Cl. ..... 246/415 A; 246/389; 238/10 E

[58] Field of Search ..... 246/382, 383, 385, 386, 246/387, 388, 389, 391, 392, 415 R, 415 A, 435 R, 445, 446, 468, 472, 380, 377, 430, 213; 238/10 E; 104/53

[56] References Cited

U.S. PATENT DOCUMENTS

| | | | |
|---|---|---|---|
| 835,845 | 11/1906 | Biggs | 246/386 |
| 942,947 | 12/1909 | Suverkrup | 246/387 |
| 981,495 | 1/1911 | Sullivan | 246/386 |
| 1,247,447 | 11/1917 | Petty | 246/392 |
| 1,313,782 | 8/1919 | Betts . | |
| 1,463,227 | 7/1923 | Ronders | 246/392 |
| 1,671,971 | 6/1928 | Cooper | 246/386 |
| 2,228,972 | 1/1941 | Pinder . | |
| 3,017,503 | 1/1962 | Kniff . | |
| 3,143,976 | 8/1964 | Wherry . | |
| 3,403,251 | 2/1971 | Pale et al. . | |
| 3,564,236 | 6/1965 | Ernst . | |
| 3,566,104 | 2/1971 | Edwards et al. | 246/415 A |
| 3,700,889 | 9/1968 | Edwards et al. . | |
| 4,476,787 | 10/1984 | Edwards . | |

FOREIGN PATENT DOCUMENTS

| | | | |
|---|---|---|---|
| 2337004 | 2/1974 | Fed. Rep. of Germany | 238/10 E |
| 2947876 | 7/1981 | Fed. Rep. of Germany | 246/415 A |
| 2431313 | 3/1980 | France | 246/415 A |
| 0244326 | 12/1925 | United Kingdom | 246/38 O |
| 1376503 | 12/1974 | United Kingdom | 246/415 A |
| 1564291 | 4/1980 | United Kingdom | 246/415 A |

*Primary Examiner*—Robert P. Olszewski
*Assistant Examiner*—Mark T. Le
*Attorney, Agent, or Firm*—Kolisch, Hartwell & Dickinson

[57] ABSTRACT

A model railroad turnout assembly includes a roadbed element having an entry track thereon. The entry track includes a pair of spaced apart entry rails. Plural, branching discharge tracks are mounted on the roadbed element, each discharge track including a pair of spaced apart discharge rails. The adjacent rails of the discharge track terminate with ends intermediate the other rails of the discharge tracks. A switch element is provided and has a pair of blades at one end thereof. A frog extends from the discharge track ends over the switch. The frog is shiftable, with the switch element, such that the frog contacts an element blade to provide a continuous rail segment between a selected entry track rail and a selected discharge track rail.

17 Claims, 3 Drawing Sheets

TURNOUT WITH CLOSING FROG

BACKGROUND AND SUMMARY OF THE INVENTION

This invention relates to model railroad equipment and specifically to turnouts.

A turnout is a device which is used in both model railroading and prototype railroading to direct a train moving on a track to one of multiple alternate routes. In the case of two-rail model railroad track, the rails are generally energized with a DC power supply from a transformer/rectifier device. In addition to directing the train to a particular track, the turnout is usually provided with some form of electrical directing mechanism in order to provide current of the proper plurality to the branch tracks.

In the normal prototype turnout, an entry track will lead into one or more discharge tracks. The entry track includes two spaced apart rails which, in most instances, are continuous with one of the rails of a discharge track. Extensions of the remaining rails of the discharge track intersect at a point intermediate the rails of the entry track and are usually joined by a device known as a frog. A pair of switch points are located adjacent the rails of the entry track and are shiftable such that, at any one time, one of the points will come into contact with one of the entry rails. The other end of the rails comprising the switch points are pivoted at a location near the frog. A gap occurs between the frog and the switch point rails.

In the case of prototype and larger scale models, the wheels on the engines and rolling stock are of sufficient size to transit the gap formed between the pivoting end of the switch points and the frog. As the scale of the models become smaller, the gap between the switch points and the frog may not remain in true scale due to limits on the machine detail which can be incorporated into the model components. Particularly in the case of N and smaller scales, the wheels of rolling stock may drop into the gap between the switch point rails and the frog resulting in a derailment.

A number of switch assemblies have been proposed to overcome this problem, two such assemblies are disclosed in our earlier U.S. Pat. Nos. 3,566,104 and 3,700,889, both entitled MODEL RAILWAY SWITCH ASSEMBLY. Although the assemblies disclosed in the identified patents are operable to close a gap between the switch points and the frog, the structural elements which accomplish such closing generally involves lateral shifting of a switch-point rail-, or blade-, carrying switch element both at the end of the switch points and at the end adjacent the frog. In the event of a non-complete shift in the position of the blade-carrying element, a gap may still be present adjacent the frog. Additionally, while the blade element is maintained in the desired position by a spring mechanism, the entrance of a high-speed train onto the turnout, particularly when the train is negotiating a curved section of the turnout, may result in undesired shifting of the blade elements and the opening of the gap adjacent the frog with the resultant derailment of the train.

It is an object of the present invention, therefore, to provide a model railroad turnout which provides for continuous rail segments on both rails of a track along the length of the turnout.

Another object of the invention is to provide a movable frog which closes any gap as such may exist between the rails on a switch element and the discharge rails of the turnout.

A further object of the invention is to provide a turnout which will not yield under the centripetal force of a train passing thereover on a curved path.

Another object of the invention is to provide a turnout which provides for selective electrification of a frog and the rails adjacent thereto.

The model railroad turnout assembly of the invention includes a roadbed element having an entry track thereon. The entry track includes a pair of spaced apart entry rails. Plural, branching discharge tracks are mounted on the roadbed element, each discharge track including a pair of spaced apart discharge rails. The adjacent rails of the discharge tracks terminate with ends intermediate the other rails of the discharge tracks. The adjacent rails extend along lines which intersect at a point beyond the ends of the adjacent rails. A switch element is provided and has a pair of blades spaced apart a lesser distance than the entry rails. The blades have points at one end thereof which are alternately shiftable with the switch element into a contacting relationship with one only of the rails of the entry track. The other end of the switch element is located adjacent the discharge track ends. A frog extends between the discharge track ends and the point of intersection. The frog is shiftable, with the switch element, such that the frog contacts an element blade to provide a continuous rail segment between the entry track rail and the discharge track rail.

These and other objects and advantages of the invention will become more fully apparent as the description which follows is read in conjunction with the drawings.

DETAILED DESCRIPTION OF A PREFERRED EMBODIMENT

Figure 1:
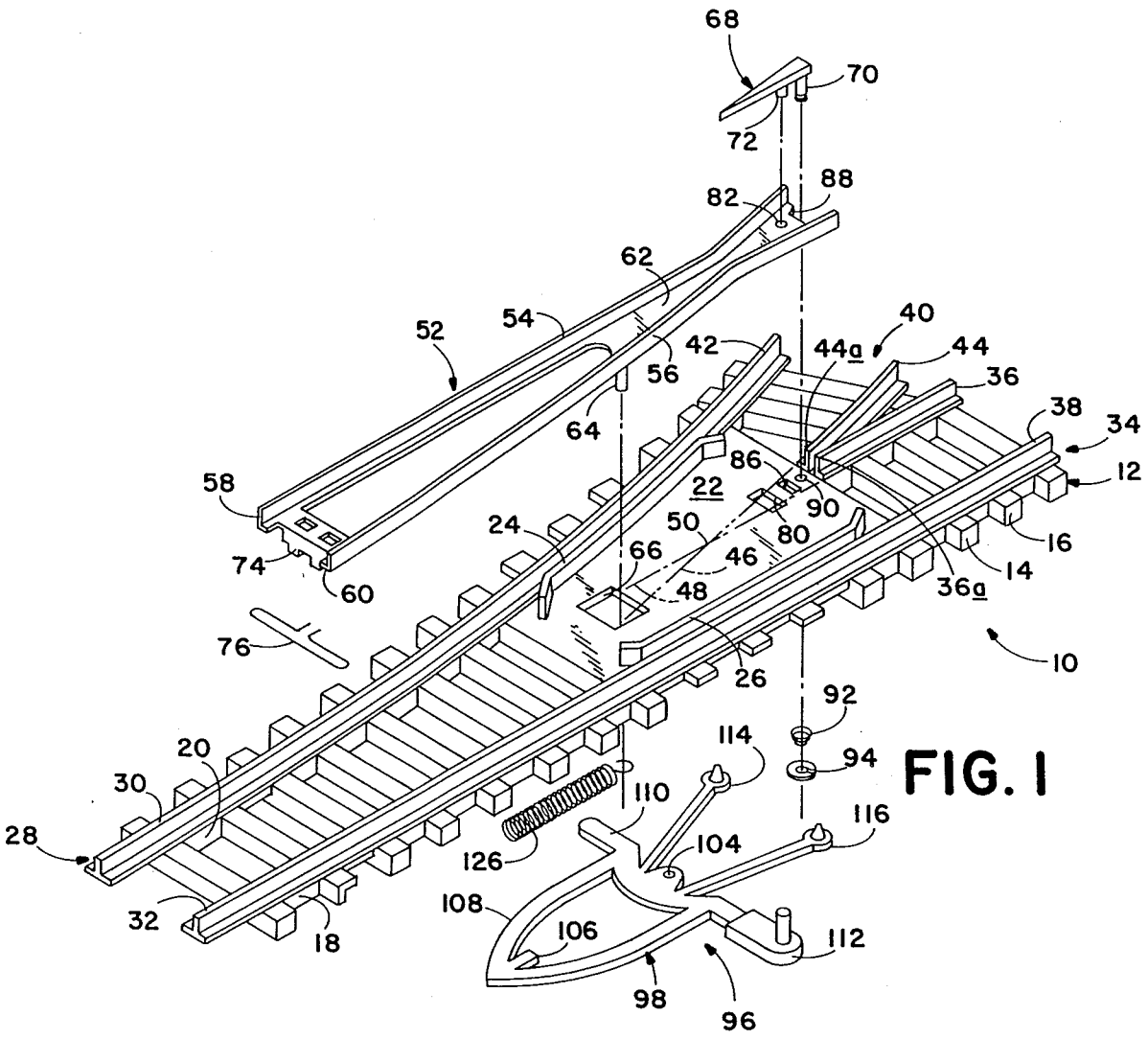
FIG. 1 is an exploded, perspective view of a model railroad turnout constructed according to the invention.

Referring initially to FIG. 1, a model railroad turnout constructed according to the invention is shown generally at 10. Turnout 10 includes a roadbed element 12 which is, in the preferred embodiment, integrally molded from a plastomer material and includes formed ties, such as ties 14, 16 and stringers 18, 20 which join the ties together. A switching-mechanism platform 22 is formed as part of roadbed element 12 and includes guard rails 24, 26.

An entry or infeed track 28 is depicted at the left side of the drawing. Entry track 28 includes a pair of spaced apart entry rails 30, 32 which are mounted on roadbed element 12.

A pair of discharge tracks are located at the other end of the turnout and include a straight discharge track 34, having discharge rails 36, 38, and a curved discharge track 40, having discharge rails 42, 44. One rail of each discharge track is continuous with a rail of the entry track, for instance, straight discharge rail 38 is continuous with entry rail 32 while curved discharge rail 42 is continuous with entry rail 30. The other rail of each discharge track terminates with an end, such as end 44*a*, 36*a* intermediate the continuous rails. As used herein, a discharge track is that branching portion of the turnout extending beyond the ends of discharge rails 36, 44. Rails 44, 36 approach each other adjacent their ends 44*a*, 36*a*, respectively, and follow lines 46, 48 which intersect at a point 50 beyond the ends of the adjacent rails, intermediate the continuous rails. In the case of prototype or convention model turnouts, the area between the ends of rails 44 and 36 and point 50 would be filled with a conventional frog.

An elongate blade or switch element 52 includes a pair of blades, or rails, 54, 56 and is operable to direct a train from the entry track to either discharge track. Element 52 includes spaced apart rail points 58, 60 at one end thereof which are arranged between rails 30, 32 of entry track 28. Blades 54, 56 converge towards one another between points 58, 60 and region of rail ends 36*a*, 44*a*. Element 52 includes a web 62 which joins blades 54, 56 and which has a downwardly depending pin 64 extending from the bottom side thereof. Pin 64 extends through a hole 66 in platform 22 and provides an attachment point for a shifting mechanism, which will be described later herein. In the case of a conventionally designed turnout, a switch element may be pivotably mounted adjacent a conventional frog or may be shiftably mounted adjacent the conventional frog. In either event, a gap will be present between the frog and the ends of the rails adjacent the frog.

In the preferred embodiment, an elongate, gap-closing frog 68 is pivotably mounted on platform 22. Frog 68 has a pivot pin 70 formed on one end thereof and a connecting pin 72 located inboard and adjacent pivot pin 70. Frog 68, in the preferred embodiment, has a generally triangular form with the apex thereof extending over web 62 of switch element 52.

If frog 68 were not pivotably mounted, a gap would exist between the frog and switch element 52. Frog 68 is mounted on platform 22 such that it extends beyond the ends of discharge rails 44, 36, with its apex extending to the location of intersection point 50.

Figure 5:
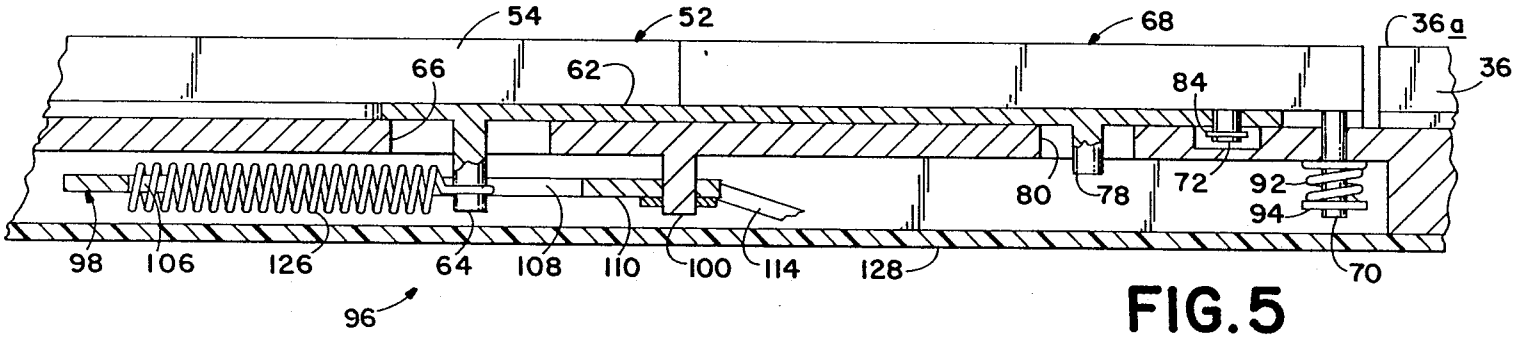
FIG. 5 is a greatly enlarged medial sectional view of the turnout taken generally along the line 5—5 of FIG. 2.

Referring now to FIGS. 1 and 5, the relationship between frog 68 and switch element 52 will be further described. An insulated retainer 74 is fixed to element 52 at one end thereof. Retainer 74 is constructed and arranged to extend below the level of rails 30, 32 and has grooves therein to receive a spring clip 76 which holds one end of the switch element in place while allowing for shifting thereof between entry rails 30, 32. A portion of stringers 18, 20 is cut away at the position of spring clip 76 to facilitate installation of the clip. Switch element 52 is positioned on platform 22 with pin 64 extending through hole 66. A second switch-element pin 78 extends through a second hole 80 formed in platform 22.

Frog 68 is connected to switch element 52 by means of connecting pin 72 on frog 68, which extends through a connecting bore 82 and is held in place by a split ring 84. Ring 84 is received in a groove extending about the lower end of connecting pin 72. A depressed area 86 is formed in platform 22 to allow free movement of the protruding end of pin 72 and split ring 84.

A notch 88 is formed in the other end of switch element 52 and provides clearance for pivot pin 70, which is received in a bore 90 formed in platform 22 and which underlies notch 88. Pivot pin 70 is pivotably secured to platform 22 by means of a coil spring 92 and a split ring 94. Spring 92 urges frog 68 towards platform 22 and also causes frog 68 to hold the free end of switch element 52 in place on platform 22. Frog 68 is thus shiftable with switch element 52, and shifts in the same direction as the switch element. The frog is operable to close any gap which may exist between the ends 36*a*, 44*a* of discharge rails 36 and 44 and blades 52, 56, respectively.

Figure 4:
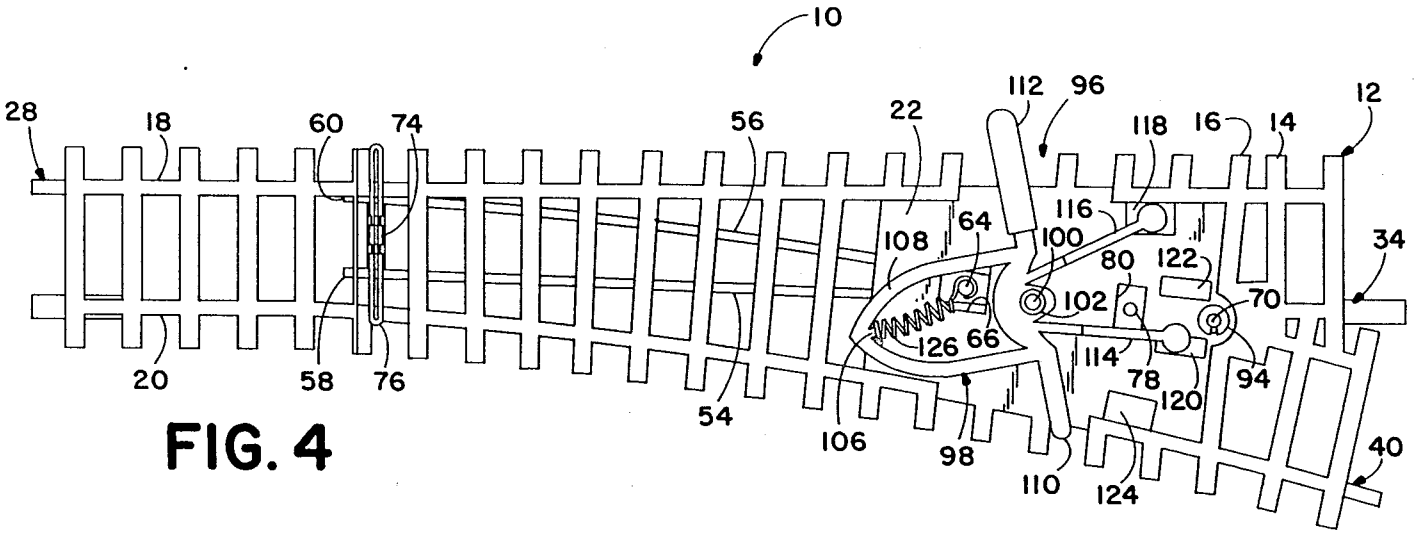
FIG. 4 is a bottom plan view of the turnout of FIG. 3.

Referring now to FIGS. 1, 4 and 5, shifting means, shown generally at 96, is provided for shifting blade element 52 and frog 68. Shifting means 96 includes a spring toggle actuator 98 which is pivotably mounted on a pin 100, formed on the bottom side of platform 22, and secured thereto by a split ring 102. Actuator 98 includes a bore 104 which receives pin 100. A spring receiver 106 which is located at one end of a loop 108, which extends to one side of a cross piece 110. A position selector 112 is located at one end of cross piece 110 and is constructed and arranged to be connected to a mechanical switch operating device or, the position selector may be manually activated. Contact arms 114, 116 extend from cross piece 110 and are operable to complete an electrical circuit between contacts 118, 120 or 122, 124 located on the bottom side of platform 22 and connected to rails 38, 44, 36, 42, respectively.

A toggle spring 126 is received at one end thereof on spring receiver 106. In the preferred embodiment, a coil spring is used as toggle spring 126, however, other types of over-center devices may be used. The other end of toggle spring 126 is formed into a loop which is received in a groove which extends about switch element pin 64. Shifting means is operable to position switch element 52 and frog 68 into one of two opposed positions, depending upon the orientation of actuator 98. In the preferred embodiment, actuator 98 is formed of a conductive material, such as copper. However, a non-conductive material may be used so long as some means is provided in conjunction with actuator 98 for providing a selected electrical circuit between the contacts located on the bottom side of platform 22.

Referring now to FIG. 5, a bottom plate 128 is depicted in this figure only. The bottom plate serves as a cover for the shifting means and provides additional stability for the turnout. Plate 128 has been deleted from FIGS. 1–4 for purposes of clarity.

OPERATION

Figure 2:
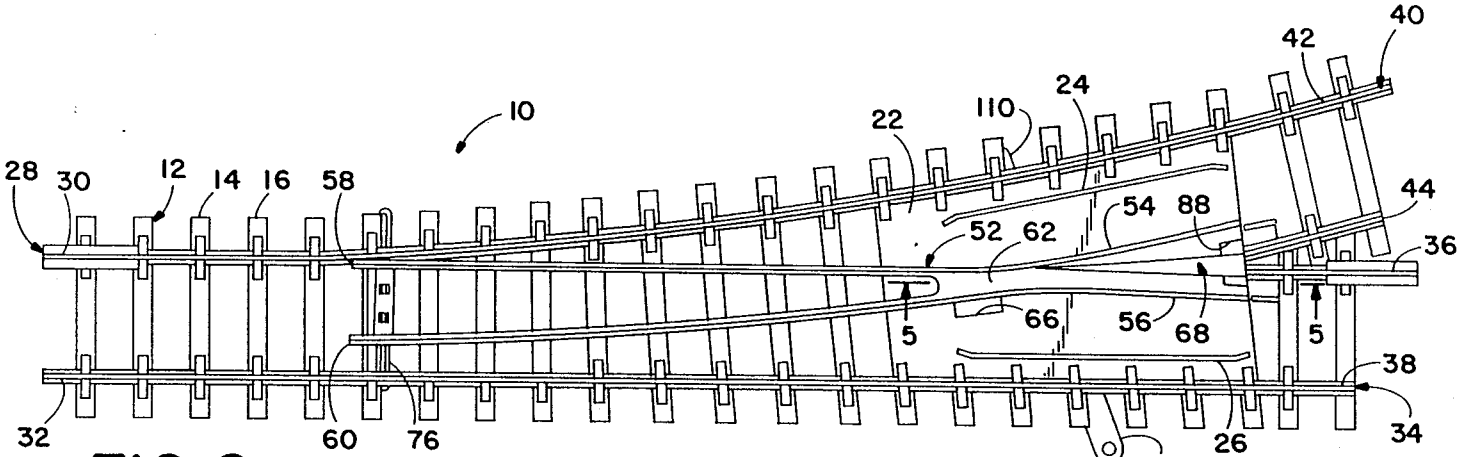
FIG. 2 is a top plan view of the turnout with a blade element shifted to provide straight travel of a train through the turnout.

Referring now to FIG. 2, turnout 10 is depicted with switch element 52 in a straight position. Position selector 112 is shifted to its straight position resulting in switch element 52 being directed toward rail 30 and frog 68 is shifted with switch element 52 to contact blade 54. The switch element and frog are yieldably biased to this straight datum position by toggle spring 126. In this position, a continuous rail segment is formed between entry rail 30 and discharge rail 36 by virtue of blade 54 and frog 68 providing an unbroken support for a train moving over the turnout. Contact is maintained between rail point 58 and entry rail 30. There is no contact between rail point 60 and entry rail 32.

Figure 3:
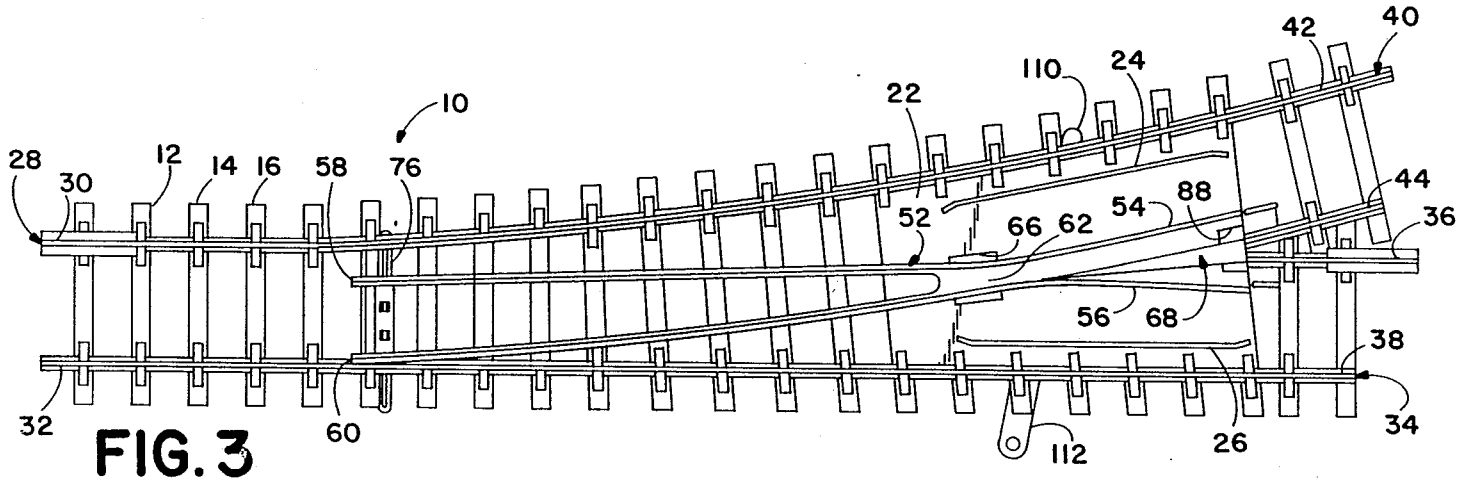
FIG. 3 is a top plan view of the turnout with a blade element shifted to provide curved travel of a train through the turnout.

Referring now to FIGS. 3 and 4, position selector 112 has been shifted to a turning or curved travel position, causing toggle spring 126 to urge and yieldably hold switch element pin 64, the switch element and the frog to a curved datum position where rail point 60 contacts rail 32/38 and where frog 68 shifts with switch element 52 to contact blade 56, thereby providing a continuous rail segment between infeed rail 32 and discharge rail 44. Contact is maintained between rail point 60 and entry rail 32 while contact is broken between rail point 58 and entry rail 30.

Referring now to FIG. 4, as previously noted, toggle actuator 98 is operable to selectively electrify the discharge tracks. Discharge tracks 42 and 38 are electrified by means of their continuous nature with infeed tracks 30, 32, respectively. However, discharge tracks 44, 36 may, in some embodiments of the turnout, constitute a single electrical element in which case it is not possible to maintain correct polarity through the turnout if the element is continuously energized. To this end, contacts 118 through 124 are provided on the bottom of platform 22. As toggle actuator 98 is shifted between the straight and curved positions, contact arms 114, 116 will provide electrical energy of the correct polarity to the discharge rail. For instance, with switch element 52 in the curved position, the element and frog draw electrical energy from rail 32 by virtue of physical contact therewith. It is necessary to provide electrical energy of the proper polarity to rail 44 and this is accomplished by forming an electrical circuit between contact 118, connected to rail 32, and contact 120 which is connected to rail 44, thus maintaining the correct polarity between the entry and discharge rails.

Although a preferred embodiment of the invention has been described herein, the invention is not restricted to the particular embodiment which has been described, since variations may be made therein without departing from the scope of the invention as defined in the appended claims.

It is claimed and desired to secure by Letters Patent:

1. A model railroad turnout comprising:

a roadbed element;

an infeed track having a pair of spaced apart infeed rails mounted on said roadbed element;

plural outfeed tracks mounted on said roadbed element, each track having a pair of spaced apart outfeed rails, wherein one rail of each pair of the outfeed track is continuous with an infeed rail, and an extension of the other rail of each outfeed pair intersect one another at a point intermediate said infeed rails;

an elongate blade element for directing a model train traveling from the infeed track onto a related outfeed track, said blade element including a pair of spaced apart rails having rail points at one end of the blade element arranged between the rails of the infeed tracks and laterally shiftable to provide contact between only one point and only one of said infeed rails, the blade element rails converging towards one another at the other end of the blade element, said blade element and the other rail of each outfeed pair defining a gap therebetween each of said spaced apart rails of said blade element being a single continuous rail extending from said one end to said other end of said blade element;

an elongate frog pivotably mounted on said roadbed element at one end of said frog, said frog extending over said blade element and being pivotably mounted thereto, connection means for directly connecting said frog to said blade element, said frog being constructed and arranged to pivot with lateral movement of said blade element to close said gap between a selected blade element rail and a selected outfeed rail.

2. The turnout of claim 1 wherein said blade element includes a notch formed at the other end thereof, said frog includes a pivot pin at one end thereof and said roadbed element includes a bore extending therethrough underlying said notch for receiving said pivot pin therethrough.

3. The turnout of claim 2 wherein said blade element includes a connecting bore therein adjacent said notch and wherein said connection means includes a connecting pin on said frog constructed and arranged to extend into said connecting bore.

4. The turnout of claim 1 which further includes shifting means for shifting said blade element.

5. The turnout of claim 4 wherein said shifting means includes electrifying means for selectively electrifying one of said outfeed tracks.

6. In a model railroad turnout assembly for selectively directing a model train to one of plural track pairs, an improved switching mechanism comprising:

a roadbed element;

an entry track including a pair of spaced apart entry rails;

plural, branching discharge tracks, each including a pair of spaced apart discharge rails, the adjacent rails of the discharge tracks terminating with ends intermediate the other rails of the discharge tracks, said adjacent rails extending along lines which intersect at a intersection point between said entry rails beyond the ends of said adjacent rails;

a switch element having a pair of blades spaced apart a lesser distance than said entry rails, said blades having points at one end of the switch element, which points are alternately laterally shiftable with said switch element into a contacting relationship with one only of said rails of said entry track, the other end of said switch element being located adjacent said discharge track ends each of said blades being a single continuous rail extending from said one end to said other end of the switch element; and a frog extending from said discharge track ends into said switch element, which is shiftable with said switch element such that said frog contacts a blade to provide a continuous rail segment between a selected entry track rail and a selected discharge track rail.

7. The turnout of claim 6 wherein said switch element includes a notch formed at the other end thereof, said frog includes a pivot pin at one end thereof and said roadbed element includes a bore extending therethrough underlying said notch for receiving said pivot pin therethrough.

8. The turnout of claim 7 wherein said switch element includes a connecting bore therein adjacent said notch and said frog includes connection means for connecting said frog to said blade element, wherein said connection means includes a connecting pin on said frog constructed and arranged to extend into said connecting bore.

9. The turnout of claim 6 which further includes shifting means for shifting said switch element.

10. The turnout of claim 9 wherein said shifting means includes electrifying means for selectively electrifying one of said outfeed tracks.

11. In a model railroad turnout assembly for selectively directing a model train to one of plural track pairs, an improved switching mechanism comprising:

an entry track including a pair of spaced apart entry rails;

plural, branching discharge tracks, each including a pair of spaced apart discharge rails, the adjacent rails of the discharge tracks having ends intermediate the other rails of the discharge tracks, said adjacent rails extending along lines which intersect at a point between said entry rails beyond the ends of said adjacent rails;

a switch element having a pair of blades spaced apart a lesser distance than said entry rails, said blades having points at one end of the switch element which points are shiftable with said switch element into a contacting relationship with one only of said rails of said entry track, the other end of said switch element being located adjacent said discharge track ends and including a web having a connecting bore extending therethrough and a notch located therein at the other end of said switch element, said switch element being yieldingly biased to a datum position each of said blades being a single continuous rail extending from one end to the other end of the switch element;

a roadbed element carrying said entry track, said discharge tracks and said switch element thereon, and having a bore extending therethrough underlying said notch in said switch element; and a generally triangular shaped frog, extending between said discharge track ends and said point of intersection, which is shiftable by said switch element in the same lateral direction of movement as the switch element with the apex of the triangular shape contacting a selected blade to provide a continuous rail segment between a selected entry track rail and a selected discharge track rail, and which includes a pivot pin located on the underside thereof at one end thereof, said pivot pin extending downwardly through said switch element notch and said bore in said roadbed element and a connecting pin located on the underside of said frog adjacent said pivot pin, said connecting pin extending downwardly through said connecting bore in said switch element.

12. The turnout of claim 11 which further includes shifting means for shifting the datum position of said switch element.

13. The turnout of claim 12 wherein said shifting means includes electrifying means for selectively electrifying one of said discharge tracks.

14. The turnout of claim 1 wherein said blade element includes a web extending between the rails thereof,and wherein said web element underlies said frog, said frog including a pivot pin at one end thereof and said road bed element including a bore extending therethrough underlying said frog for receiving said pivot pin therethrough.

15. The turnout of claim 14 wherein said web includes a connecting bore therein and wherein said connection means includes a connecting pin on said frog constructed and arranged to extend into said connecting bore.

16. The turnout of claim 6 wherein said switch element includes a web extending between the blades thereof and wherein said web element underlies said frog, said frog including a pivot pin at one end thereof and said road bed element including a bore extending therethrough underlying said frog for receiving said pivot pin therethrough.

17. The turnout of claim 16 wherein said web includes a connecting bore therein and wherein said connection means includes a connecting pin on said frog constructed and arranged to extend into said connecting bore.

* * * * *